United States Patent [19]

Kudou et al.

[11] Patent Number: 5,015,164

[45] Date of Patent: May 14, 1991

[54] ROTARY COMPRESSOR HAVING LONG LENGTH BLADE

[75] Inventors: Motohiro Kudou, Numazu; Yutaka Sasahara, Fuji, both of Japan

[73] Assignee: Kabushiki Kaisha Toshiba, Kawasaki, Japan

[21] Appl. No.: 391,710

[22] Filed: Aug. 10, 1989

Related U.S. Application Data

[63] Continuation of Ser. No. 212,673, Jun. 28, 1988, abandoned.

[30] Foreign Application Priority Data

Jul. 28, 1987 [JP] Japan ..... 62-115485[U]

[51] Int. Cl.[5] ..... F04C 18/356

[52] U.S. Cl. ..... 418/63

[58] Field of Search ..... 418/63, 65, 243–249, 418/251

[56] References Cited

U.S. PATENT DOCUMENTS

| | | | |
|---|---|---|---|
| 2,458,018 | 1/1949 | Muran | 418/248 X |
| 4,561,829 | 12/1985 | Iwata et al. | 418/63 X |

FOREIGN PATENT DOCUMENTS

| | | | |
|---|---|---|---|
| 942066 | 4/1956 | Fed. Rep. of Germany | 418/248 |
| 54-95913 | 7/1979 | Japan . | |
| 57-10495 | 1/1982 | Japan . | |
| 62-82291 | 4/1987 | Japan | 418/248 |

*Primary Examiner*—John J. Vrablik

*Attorney, Agent, or Firm*—Cushman, Darby & Cushman

[57] ABSTRACT

A rotary compressor includes a cylinder having a cylindrical compressing chamber, an eccentrically movable rotor disposed in the compressing chamber, and a reciprocally movable blade disposed in a blade guide groove which extends from the compressing chamber in a radial direction. The blade is provided with a pair of projections respectively extending from the one end of the blade toward the bottom of the blade guide groove, and the other end of the blade contacts the peripheral surface of the rotor. A pair of depressions are respectively formed at the bottom of the blade guide groove for permitting the projection pairs of the blade to reciprocally move into the corresponding depressions, thereby increasing the contacting portion between the blade and the blade guide groove in comparison with a conventional rotary compressor when the blade moves into the compressing chamber at a prescribed length.

6 Claims, 3 Drawing Sheets

ROTARY COMPRESSOR HAVING LONG LENGTH BLADE

This is a continuation of application Ser. No. 07/212,673, filed Jun. 28, 1988 , now abandoned.

BACKGROUND OF THE INVENTION

1. Field of the Invention

This invention relates to rotary compressors used for an apparatus, e.g., air conditioners, refrigerators, etc., for compressing a gaseous fluid.

2. Description of the Prior Art

In general, a rotary compressor is used with a refrigerating circuit for compressing a gaseous fluid. FIGS. 1 and 2 show a conventional rotary compressor. A rotary compressor 11 typically includes a cylinder 13, a rotation shaft 15 and a blade 17. A compressing chamber 19 is defined by the inner surface of cylinder 13. A pair of bearing (not shown) are respectively arranged to the opposite ends of cylinder 13 to establish compressing chamber 19. Rotation shaft 15 penetrates compressing chamber 19 and is rotatably supported by the pair of bearings. Compressing chamber 19 is provided with a roller 21. A penetrating hole is formed at the center of roller 21. Rotation shaft 15 extends through the penetrating hole. The outer surface of an eccentric portion 15*a* of rotation shaft 15 loosely contacts the inner surface of roller 21. An eccentric amount of eccentric portion 15*a* from the center of rotation shaft 15 is indicated by a distance E. Therefore, roller 21 eccentrically rotates along the inner surface of cylinder 13 in response to the rotation of shaft 15. A blade guide groove 23 extends from the inner surface of cylinder 13 toward the outer surface of cylinder 13 in the radial direction of cylinder 13. Blade 17 which has a length $l_1$ is disposed in blade guide groove 23, and is forcibly urged toward roller 21 by a spring 25 shown in FIG. 3 to reciprocate along balde guide groove 23 in response to the eccentric rotation of roller 21. As shown in FIG. 3, one end of spring 25 is supported by a channel formed at the one side of blade 17. The other end of spring 25 is supported by the inner surface of a compressor housing (not shown) when compressor is assembled into the housing. Therefore, as described above, the other side of blade 17 is always in contact with the outer surface of roller 21. Blade 17 partitions compressing chamber 19 into a high pressure cell and a low pressure cell for compressing a gaseous fluid, e.g., refrigerant, fed to compressing chamber through an intake port 27 in response to the eccentric rotation of shaft 15.

In the above described conventional rotary compressor 11, however, if the stroke of blade 17 is longer than the length of blade 17, a portion of blade 17 which is supported by balde guide groove 23 becomes small when blade 17 comes to a lower dead point, as shown in FIG. 1. When rotation shaft 15 rotates in the direction indicated by arrow A, blade 17 always is subject to the difference in pressure between the intake side cell (low pressure side) and the discharge side (high pressure side) during the compressing operation. Therefore, a moving resistance between blade 17 and blade guide groove 23 increases when blade 17 approaches the lower dead point. In other words, the pressure acting on the unit area of the inner side surface of blade guide groove 23 by blade 17 increases, as blade 17 comes to the lower dead point. As a result, the power consumption of compressor 11 increases, and the compression ability of compressor 11 is reversely affected.

To avoid disadvantages described above, inventors of the present invention have attempted to increase the length of blade 17 in a reciprocating direction. The length of blade guide groove 23 also was increased. With this construction, the contacting area between blade 17 and blade guide groove 23 can be increased in the reciprocating direction when blade 17 is at the lower dead point. However, the stiffness of cylinder 13 decreases because of the increase of the length of blade guide groove 23. The thickness of cylinder 13 should be increased so that the stiffness of cylinder 13 is increased, resulting in a large external shape of compressor 11 as well as the increase in cost.

SUMMARY OF THE INVENTION

Accordingly, it is an object of the present invention to decrease the pressure acting on a unit area of the inner side surface of a blade guide groove by a blade of a rotary compressor when the blade is positioned at a lower dead point.

To accomplish the above object, a rotary compressor includes a cylinder having a substantially cylindrical compressing chamber for temporarily storing a gaseous fluid, and a guide groove extending from the compressing chamber in a radial direction. The rotary compressor also includes a reciprocally movable blade disposed in the guide groove for partitioning the compressing chamber into a first cell and a second cell. The movable blade includes at least one projection extending from one of the ends of the movable blade toward the bottom portion of the guide groove. The guide groove is provided with at least one depression at the bottom portion thereof for permitting the projection of the movable blade to reciprocally move into the depression. The rotary compressor further includes an eccentrically rotatable rotor associated with the movable blade for compressing the gaseous fluid in the compressing chamber to a prescribed level.

BRIEF DESCRIPTION OF THE DRAWINGS

These and other objects and advantages of this invention will become apparent from the following detailed description of the presently preferred embodiment of the invention, taken in conjunction with the accompanying drawings of which.

DETAILED DESCRIPTION OF THE PREFERRED EMBODIMENT

Figure 4:
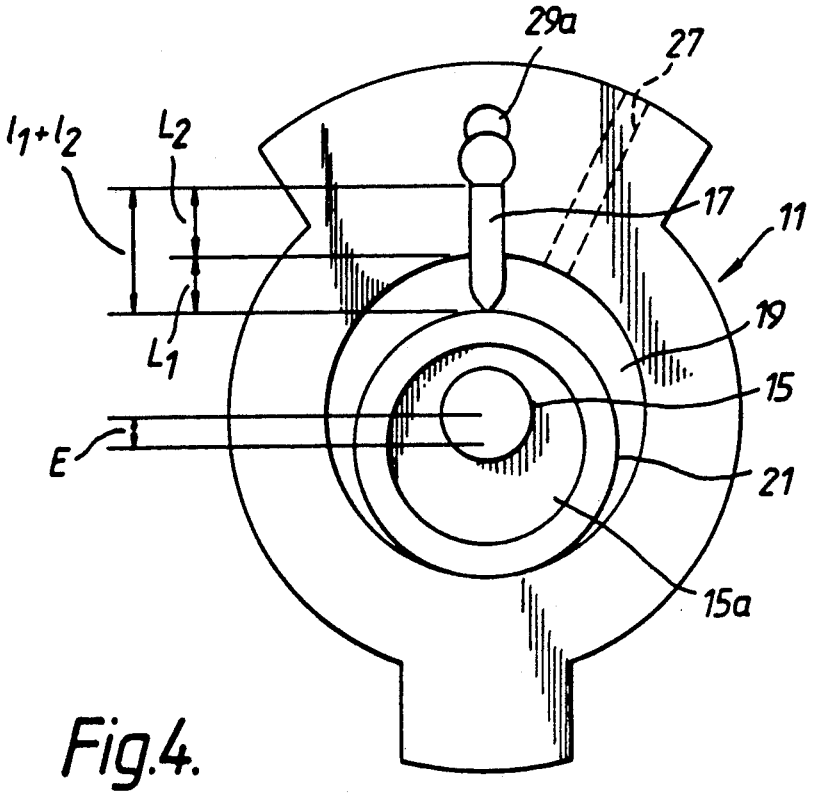
FIG. 4 is a cross sectional view illustrating a rotary compressor of one embodiment of the present invention when a blade is positioned at a lower dead point.
Figure 5:
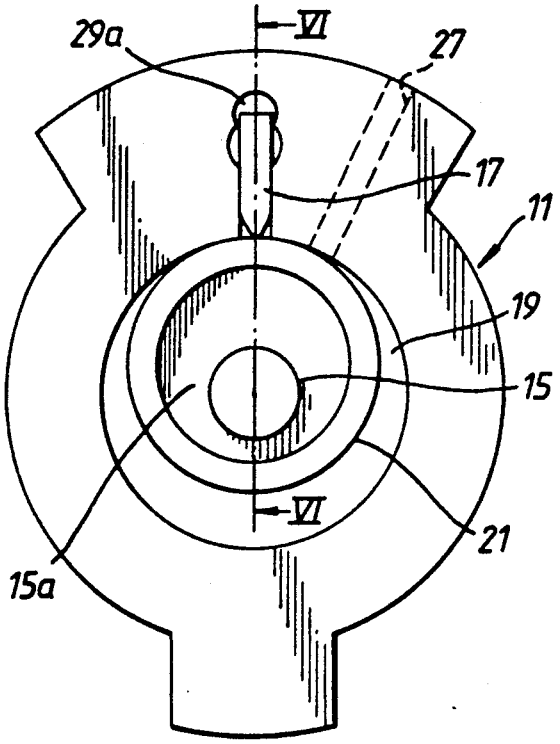
FIG. 5 is a cross sectional view illustrating the rotary compressor of FIG. 4 when the blade is disposed at an upper dead point.
Figure 6:
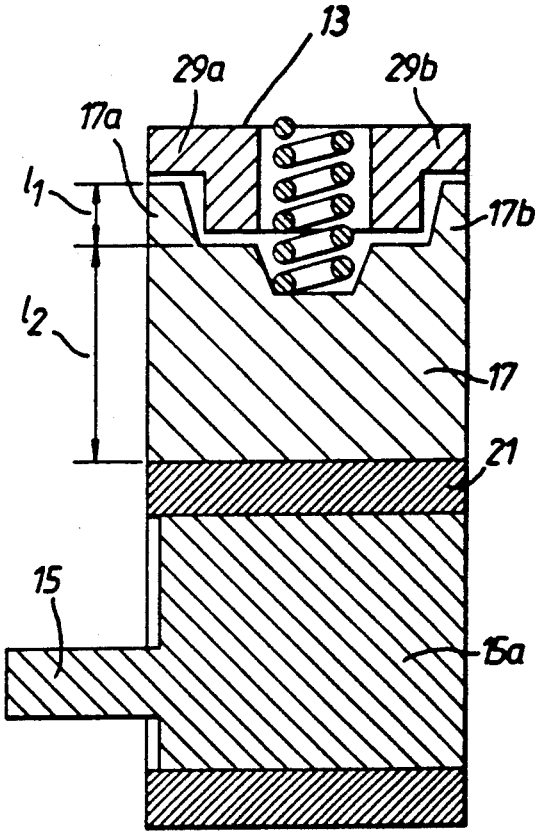
FIG. 6 is a sectional view taken on line VI—VI of FIG. 5.

The preferred embodiment of the present invention will now be described in more detail with reference to the accompanying drawings. FIGS. 4, 5 and 6 show one embodiment of the present invention. However, in the drawings, same numerals are applied to the similar element, and therefore, the detailed descriptions thereof are not repeated.

As show in FIG. 6, a pair of projecting portions 17*a*, 17*b* extend, in a reciprocating direction, from an end portion of blade 17 opposite to the other end portion which contacts roller 21 of rotation shaft 15. Each projecting portion 17*a*, 17*b* is disposed at each outer portion (right-most and left-most portions in FIG. 6), and extends at a prescribed projection length $l_1$. Therefore, the substantial length of blade 17 in the reciprocating direction increases by the length $l_1$ of projecting portion 17*a*, 17*b* compared with the prior art. The total length of blade 17 is indicated by a value $(l_1+l_2)$. A pair of depressions 29*a*, 29*b* are respectively formed to the surface of a portion of cylinder 13 corresponding to the projected end of each projecting portion 17*a*, 17*b* of blade 17. The pair of depressions 29*a*, 29*b* prevent each projecting portion 17*a*, 17*b* from colliding with the inner surface of blade guide groove 23 when blade 17 is positioned at an upper dead point, as shown in FIG. 5. each depressions 29*a*, 29*b* is formed such that it is respectively concaved from the opposite surface of cylinder 13, as shown in FIG. 6.

Figure 7:
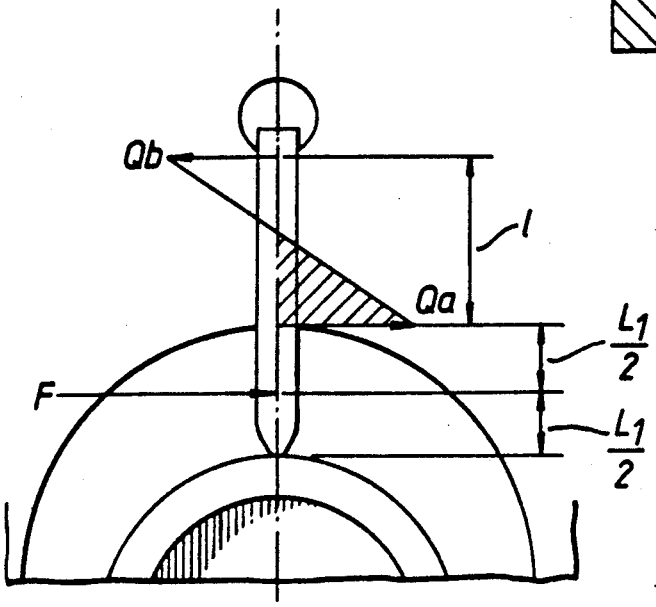
FIG. 7 is a schematic view illustrating a relationship between forces respectively acting on the opposite ends of a blade guide groove and a frictional force acting on the blade in response to the rotation of a rotor.

Regarding to the above-described embodiment, a consideration will be described hereafter in accordance with the comparison between the rotary compressor of one embodiment described above and the conventional rotary compressor. As shown in FIG. 7, each force $Q_a$, $Q_b$ is respectively a force of the blade acting on the blade guide groove due to a force F and is respectively expressed by the following equations:

$$Q_a = \frac{2F(2l + 1.5L_1)}{l^2} \quad \text{(A)}$$

$$Q_b = \frac{2F(l + 1.5L_1)}{l^2} \quad \text{(B)}$$

Wherein F is the force acting on the blade as a result of the difference in pressures on opposite sides of the blade resulting from the compression of gas, $L_1$ is the length of the blade which is in the compressing chamber, and l is the length of the blade which is in contact with the blade guide groove.

Figure 1:
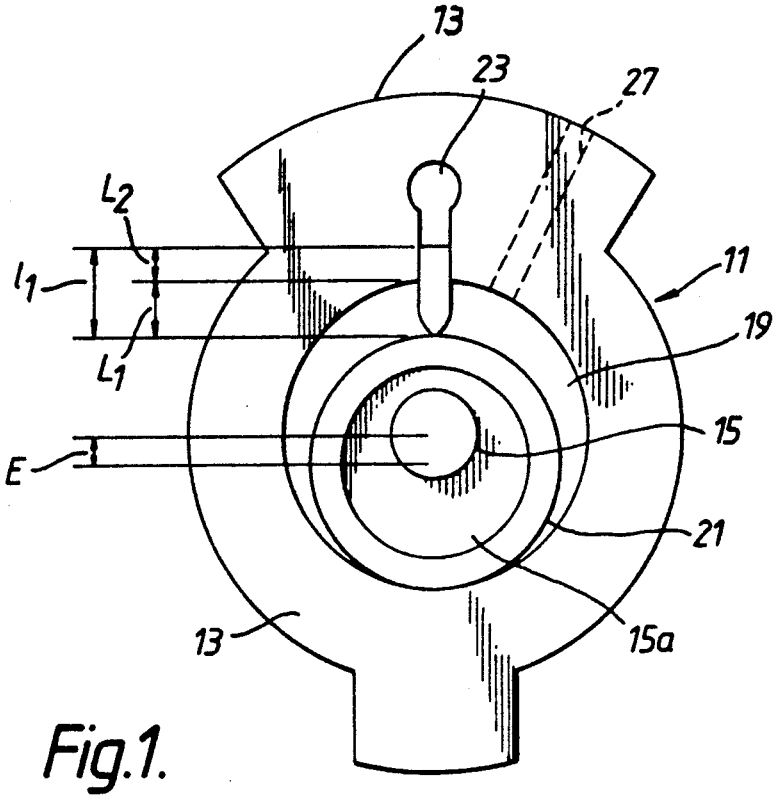
Fig.1. PRIOR ART
FIG. 1 is a cross sectional view illustrating a conventional rotary compressor when a blade is positioned at a lower dead point.
Figure 2:
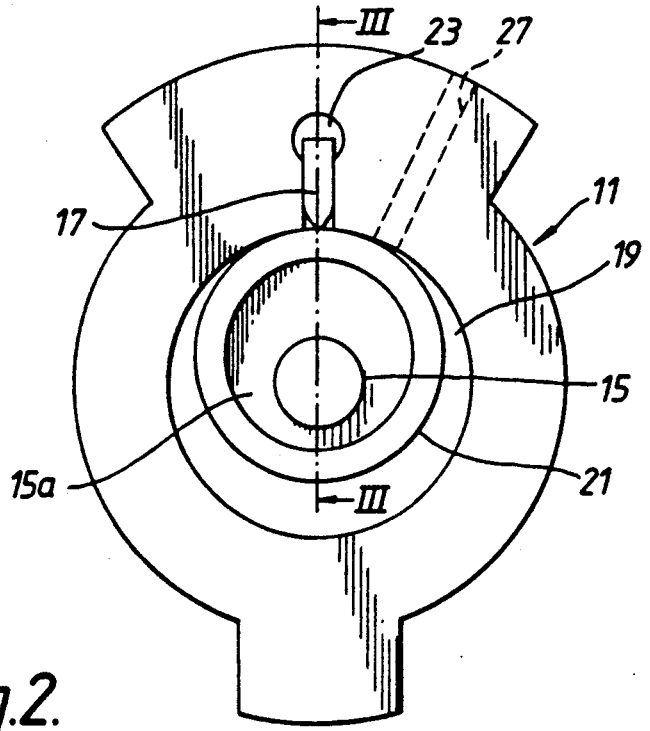
Fig.2. PRIOR ART
FIG. 2 is a cross sectional view illustrating the rotary compressor of FIG. 1 when the blade is positioned at an upper dead point.
Figure 3:
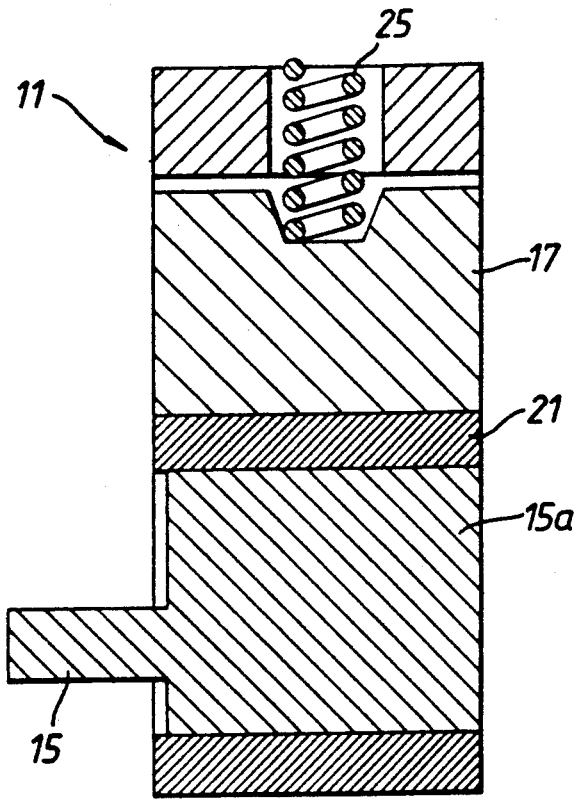
Fig.3. PRIOR ART
FIG. 3 is a sectional view taken on line III—III of FIG. 2.

Based on the above-described equations (A) and (B), each force $Q_{a1}$, $Q_{b1}$ of the conventional rotary compressor shown in FIGS. 1 and 2 is respectively expressed by the following equations (C) and (D) when the length l is substituted by a length $L_2$:

$$Q_{a1} = \frac{2F(2L_2 + 1.5L_1)}{L_2^2} \quad \text{(C)}$$

$$Q_{b1} = \frac{2F(L_2 + 1.5L_1)}{L_2^2} \quad \text{(D)}$$

Each force $Q_{a2}$, $Q_{b2}$ of the one embodiment also is respectively expressed by the following equations (E) and (F) in accordance with the equations (A) and (B) when the length l is substituted by a length $(L_2+l_2)$:

$$Q_{a2} = \frac{2F\{2(L_2 + l_2) + 1.5L_1)\}}{(L_2 + l_2)^2} \quad \text{(E)}$$

$$Q_{b2} = \frac{2F\{(L_2 + l_2) + 1.5L_1)\}}{(L_2 + l_2)^2} \quad \text{(F)}$$

It can be understood from the equations (C) and (E), the force $Q_{a2}$ of the rotary compressor of the one embodiment is smaller than the force $Q_{a1}$ of the conventional rotary compressor. Also, the force $Q_{b2}$ of the rotary compressor of the one embodiment is smaller than the force $Q_{b1}$ of the conventional rotary compressor when the equations (D) and (F) are compared with one the other. Therefore, the forces respectively acting on the opposite ends of the contacting portion of the blade in one embodiment are smaller than that of the conventional rotary compressor.

With the above-described embodiment, since the forces acting on the blade decrease, the pressure acting on a unit area of the inner side surface of the blade guide groove by the blade also reduces. Thus, power consumption of the rotary compressor may reduce. Furthermore, defacement of the contacting portions of the blade and the blade guide groove may decrease. Since the pair of depressions rarely reduce the stiffness of the cylinder, increase of thickness of the cylinder is not required. Therefore, the increase of the external shape of the rotary compressor may be avoided.

The present invention has been described with respect to a specific embodiment. However, other embodiments based on the principles of the present invention should be obvious to those of ordinary skill in the art. Such embodiments are intended to be covered by the claims.

What is claimed is:

1. A rotary compressor comprising:

a cylinder having an inner peripheral wall which defines a substantially cylindrical compressing chamber for temporarily storing a gaseous fluid;

means for defining a guide groove extending from the inner peripheral wall of the cylinder at a prescribed length in a radial direction, the guide groove having a bottom portion and communicating with the compressing chamber;

a reciprocally movable blade having opposite ends, disposed in the guide groove of the cylinder for partitioning the compressing chamber into a first compressing pressure cell and a second compressing pressure cell, the reciprocally movable blade being subject to a difference in compressing pressure between the first and second compressing pressure cells, the movable blade including at least one projection extending from one of the ends of the movable blade toward the bottom portion of the guide groove;

means for defining at least one depression at the bottom of the guide groove, the at least one depression permitting the at least one portion to reciprocally move thereinto; and an eccentrically rotatable rotor associated with the movable blade for compressing the gaseous fluid in the compressing chamber to a prescribed level, the rotor having a substantially cylindrical peripheral surface engaged by the blade for partitioning the compressing chamber into the first compressing pressure cell and the second compressing pressure cell.

2. A compressor according to claim 1 further including urging means for forcibly contacting the other end of the movable blade with the cylindrical peripheral surface of the rotor.

3. A compressor according to claim 1, wherein the cylinder includes an intake port fluidly connected to the first compressing pressure cell for permitting the gaseous fluid to flow into the first cell.

4. A rotary compressor comprising:

a cylinder having a substantially cylindrical inner wall surface and opposite side surfaces, the cylinder including a compressing chamber defined by the inner wall surface for temporarily storing a gaseous fluid, and means for defining a guide groove extending from the inner wall surface of the cylinder in a radial direction, the guide groove having a bottom portion, and communicating with the compressing chamber;

an eccentrically rotatable rotor disposed in the compressing chamber for compressing gaseous fluid in the compressing chamber;

blade means engaging the rotor for partitioning the compressing chamber into a first compressing pressure cell and a second compressing pressure cell, the blade means comprising a movable plate reciprocally moving into the compressing chamber along the guide groove in response to the rotor, the movable plate being subject to a differnce in compressing pressure between the first and second compressing pressure cells, the movable plate having opposite ends and including a pair of projections respectively extending from one of the ends of the movable plate toward the bottom portion of the guide groove having a contacting position with the movable plate, the contacting portion of the guide groove subject to pressure by the movable plate responsive to the rotation of the rotor; and means defining a pair of depressions each extending inward at a predetermined length from the opposite side surfaces of the cylinder and communicating with the guide groove in the radial direction of the cylinder for permitting the pair of projections to reciprocally move into the corresponding depressions.

5. A compressor according to claim 4, wherein the rotor has a substantially cylindrical surface, the blade means including urging means for forcibly contacting the other end of the movable plate with the cylindrical surface of the rotor.

6. A compressor according to claim 4, wherein the cylinder includes an intake port fluidly communicating with the first compressing pressure cell for permitting the gaseous fluid to flow into the first compressing pressure cell.

* * * * *